US009414154B2

(12) United States Patent
Tung et al.

(10) Patent No.: US 9,414,154 B2
(45) Date of Patent: Aug. 9, 2016

(54) WATER-REPELLENT EARPHONE

(71) Applicant: MERRY ELECTRONICS (SHENZHEN) CO., LTD., Shenzhen (CN)

(72) Inventors: Chiu-Yun Tung, Taichung (TW); Fang-Chang Hsieh, Taichung (TW); Yu-Chang Fan, Taichung (TW); Chien-Cheng Yang, Taichung (TW)

(73) Assignee: MERRY ELECTRONICS (SHENZHEN) CO., LTD. (CN)

( * ) Notice: Subject to any disclaimer, the term of this patent is extended or adjusted under 35 U.S.C. 154(b) by 121 days.

(21) Appl. No.: 14/244,128

(22) Filed: Apr. 3, 2014

(65) Prior Publication Data

US 2015/0289051 A1 Oct. 8, 2015

(51) Int. Cl.
*H04R 1/44* (2006.01)
*H04R 1/10* (2006.01)
*H04R 1/02* (2006.01)

(52) U.S. Cl.
CPC ..... *H04R 1/44* (2013.01); *H04R 1/023* (2013.01); *H04R 1/1016* (2013.01)

(58) Field of Classification Search
None
See application file for complete search history.

(56) References Cited

U.S. PATENT DOCUMENTS 4,646,872 A 3/1987 Kamon et al.
4,742,887 A * 5/1988 Yamagishi ..... H04R 1/2857 181/129
2005/0077102 A1* 4/2005 Banter ..... H04R 1/086 181/149
2012/0269375 A1* 10/2012 Tan ..... H04R 1/1016 381/380
2014/0064548 A1* 3/2014 Chu ..... H04R 1/1091 381/380
2014/0072161 A1* 3/2014 Boyle ..... H04R 1/1008 381/346

FOREIGN PATENT DOCUMENTS

JP 59144297 A * 8/1984 ..... H04R 1/44
JP 6-32526 * 4/1994 ..... H04R 1/44

OTHER PUBLICATIONS

English machine translation of JP 6-32526 (Kanbe, Yoshiyuki; Electroacoustic Transducer; published Feb. 1983).*

* cited by examiner

*Primary Examiner* — Wayne Young
*Assistant Examiner* — Mark Fischer
(74) *Attorney, Agent, or Firm* — Bacon & Thomas, PLLC

(57) ABSTRACT

A water-repellent earphone is formed of a main body and a water-repellent breathable member. The main body includes a receiving space for accommodating a speaker. The speaker partitions the receiving space to make a rear chamber. The main body includes a drainage tunnel communication with a first opening and a second opening, both of which are located on an external surface of the main body. The main body further includes a venthole communicating with the drainage tunnel and the rear chamber. The water-repellent breathable member is formed and located at the venthole. In light of the structure mentioned above, the drainage tunnel can help the earphone quickly expel the moisture to prevent the moisture from damage to the speaker and to boost the frequency response and acoustic performance within the low-frequency range.

11 Claims, 3 Drawing Sheets

WATER-REPELLENT EARPHONE

BACKGROUND OF THE INVENTION

1. Field of the Invention

The present invention relates generally to an earphone and more particularly, to a water-repellent earphone which can drain moisture quickly to prevent the built-in speaker from damage and enhance the acoustic performance.

2. Description of the Related Art

A regular earphone includes a venthole that is usually located at the rear side of the housing. When a speaker of the earphone emits sound, a venthole and a waterproof ventilative member covering the venthole jointly regulate the inflow and outflow of a gas inside a rear chamber of the earphone, thus reducing the pressure of the gas and affecting the acoustic performance of the earphone particularly for frequency response within low-frequency range.

A conventional earphone, e.g. U.S. Pat. No. 4,646,872, referring to FIG. 2, includes a housing 2 having a receiving space for receiving a speaker unit 1. A duct 7 is formed at a rear end of the housing 2 for communication with an opening of a housing cap 9 for making a gas inside a rear cavity 8 communicable with the external environment. To prevent moisture from entering the rear cavity 8, this patent disclosed a waterproof ventilative mesh 10 for covering the opening the rear cavity 9. In addition, a series of tests are applied to the frequency response of the earphone after the earphone is soaked in or doused with water. Referring to FIGS. 6 and 7 of this patent, when the earphone is wiped dry after it is soaked or doused with water, the frequency response of the earphone within the low-frequency range lowers to a certain degree and as the time passes by, the gain of the low-frequency range gradually is restored as what it is before soaked in or doused with water.

Although it is known from the aforesaid patent that the moisture indeed affects the earphone, that patent is devoid of an applicable drainage protocol, so the earphone fails to expel the moisture quickly, after it is soaked in or doused with water, and to enhance the frequency response within the low-frequency range up to what it is before the earphone soaked in or doused with water. For this reason, this conventional earphone needs further improvement.

SUMMARY OF THE INVENTION

The primary objective of the present invention is to provide a water-repellent earphone which can quickly expel moisture to prevent the moisture from entry and damage to a built-in speaker thereof and to boost the frequency response within the low-frequency range.

The foregoing objective of the present invention is attained by the water-repellent earphone formed of a main body and a water-repellent breathable member. The main body includes a receiving space formed therein and a speaker mounted inside the receiving space. The speaker partitions the receiving space to make a rear chamber. The main body includes a drainage tunnel formed therein for communication with a first opening and a second opening, both of which are located on an external surface of the main body. The main body further includes a venthole communicating with the drainage tunnel and the rear chamber. The water-repellent breathable member is formed and located at the venthole.

In light of the structure mentioned above, the drainage tunnel can help the earphone quickly expel the moisture to prevent the moisture from entering the main body of the earphone and from damage to the speaker and to quickly restore the frequency response within the low-frequency range.

Preferably, the first opening, the venthole, and the rear chamber communicate with one another linearly.

Preferably, the drainage tunnel includes a curved portion and a straight portion, both of which communicate with each other and communicate with the first opening and the second opening, respectively.

DETAILED DESCRIPTION OF PREFERRED EMBODIMENTS

Structural features and desired effects of the present invention will become more fully understood by reference to a preferred embodiment given hereunder. However, it is to be understood that the embodiment is given by way of illustration only, thus is not limitative of the claim scope of the present invention.

Figure 1:
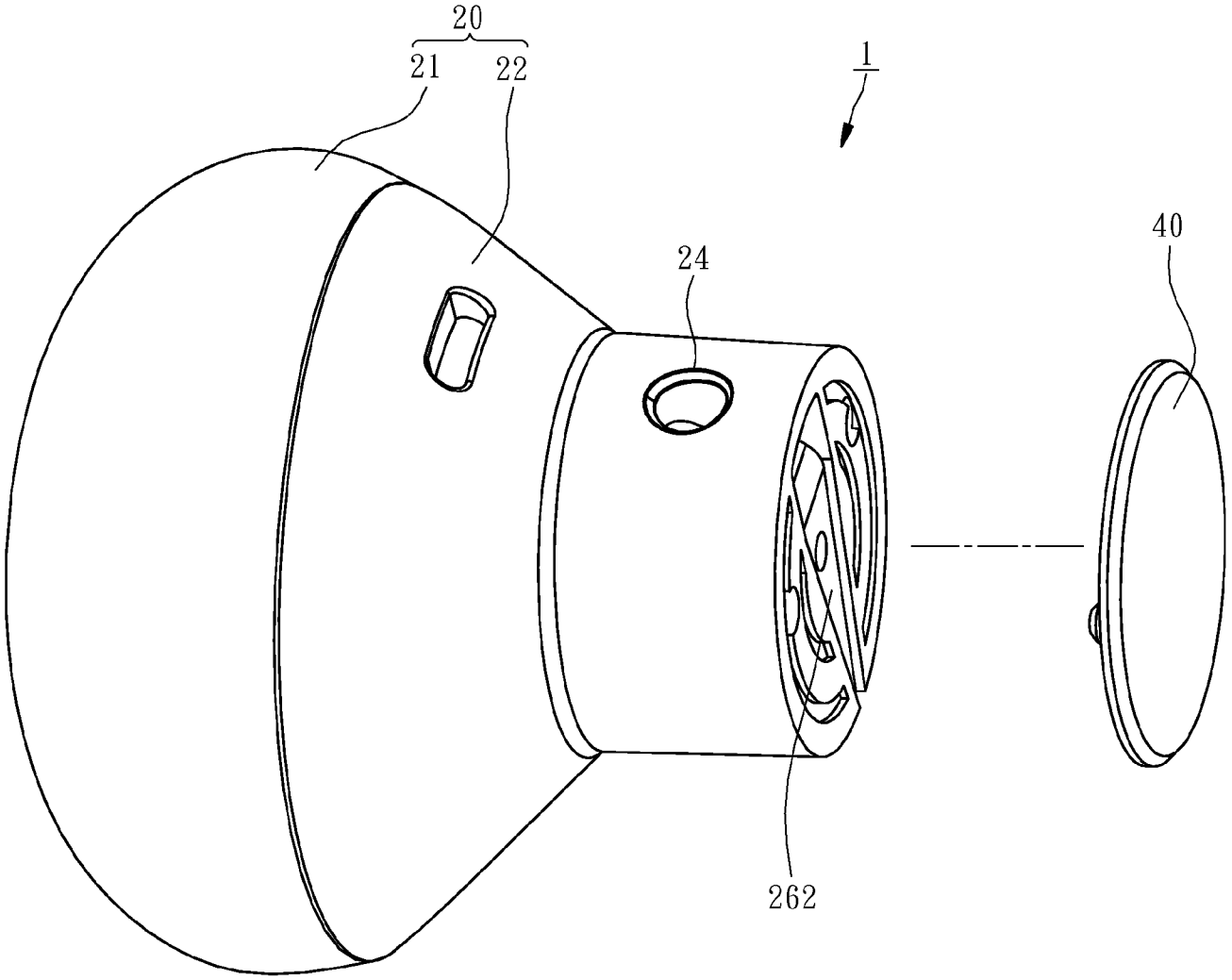
FIG. 1 is a partially exploded view of a preferred embodiment of the present invention.
Figure 2:
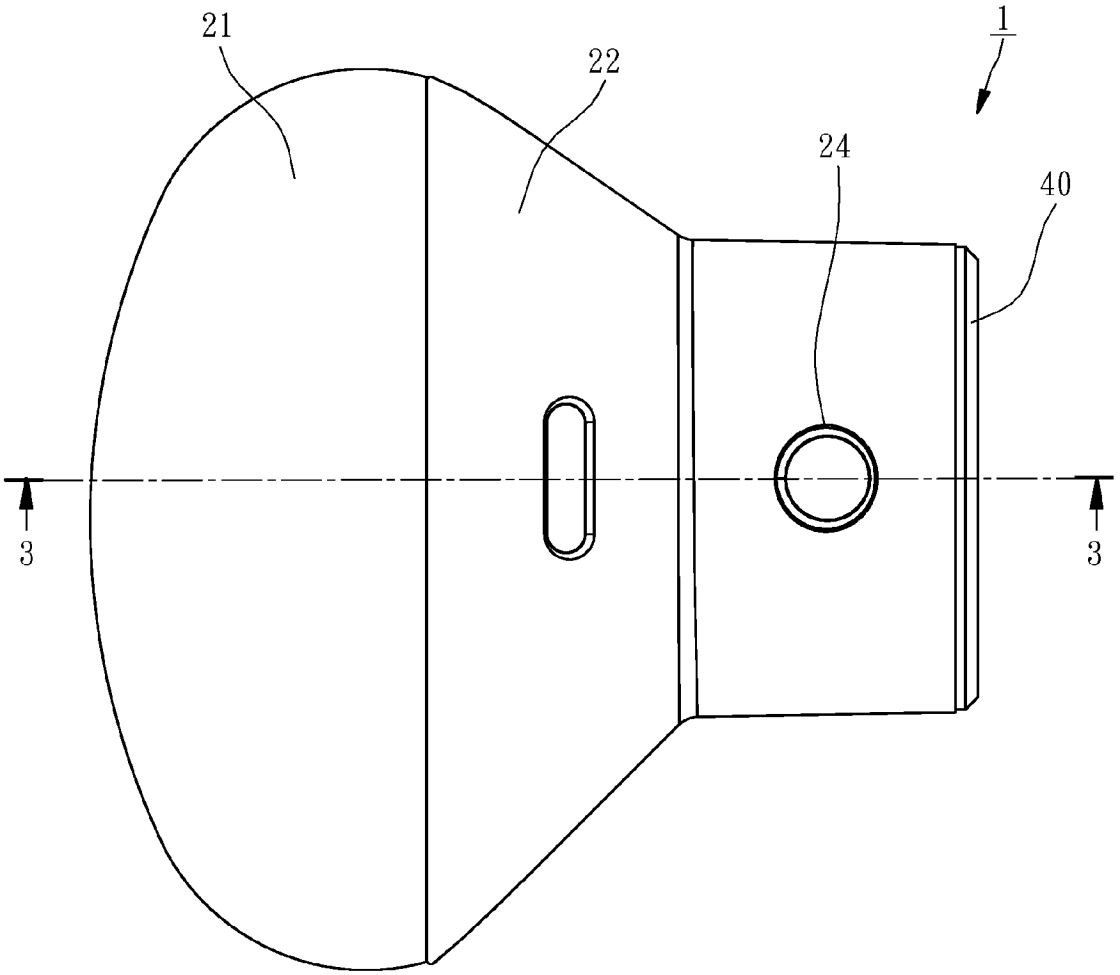
FIG. 2 is a partially top view of the preferred embodiment of the present invention.
Figure 3:
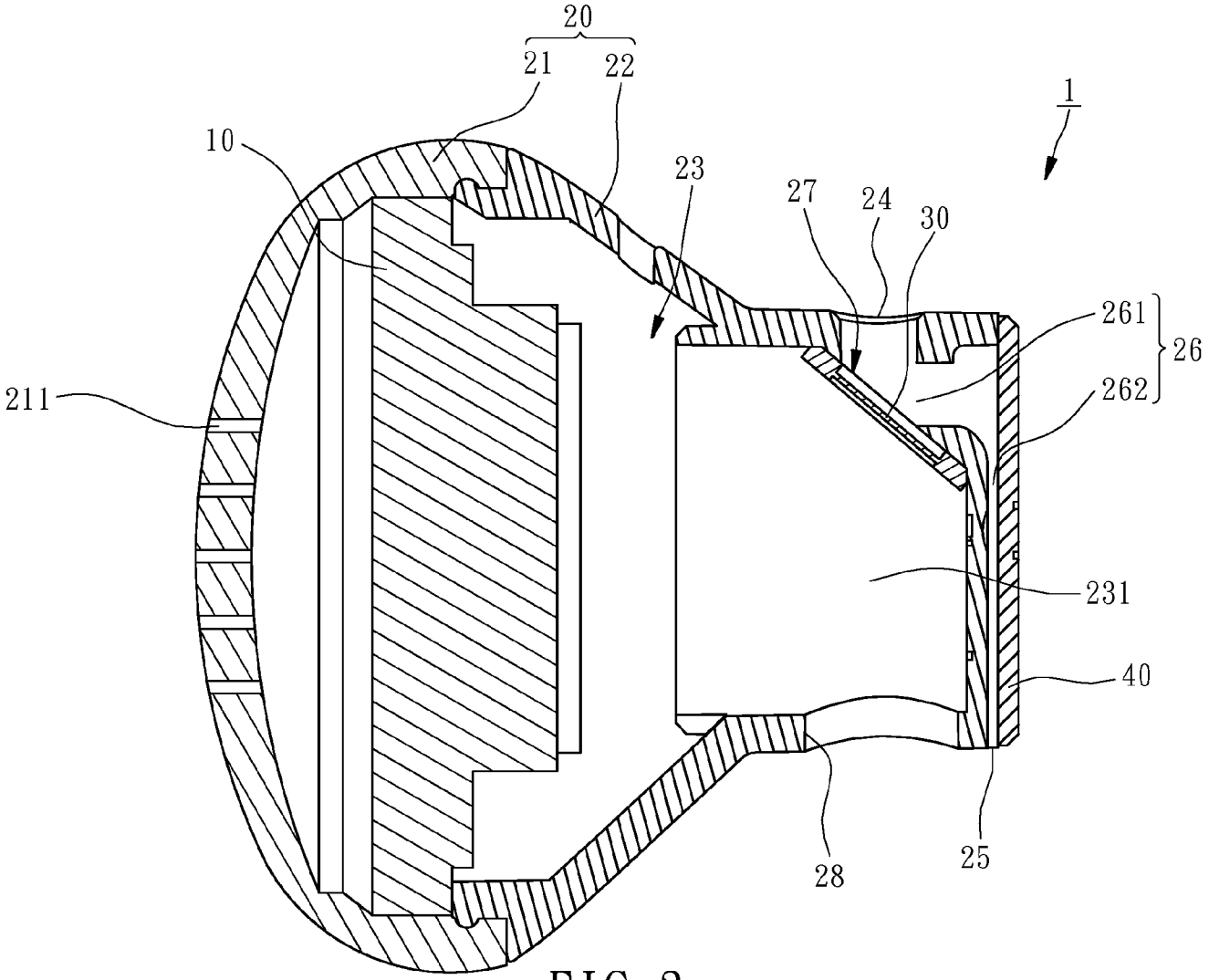
FIG. 3 is a sectional view taken along a line 3-3 indicated in FIG. 2.

Referring to FIGS. 1-3, a water-repellent earphone 1 constructed according a preferred embodiment is formed of a speaker 10, a main body 20, and a water-repellent breathable member 30. The speaker 10 serves as a sound maker. It is worth mentioning that the sounding orientation is forward-based. The detailed descriptions and operations of these elements as well as their interrelations are recited in the respective paragraphs as follows.

The main body 20 is formed of a front cover 21 and a housing 22 connected with the front cover 21. The front cover 21 is provided with a plurality of sound holes 211 for the sound to pass through. Referring to FIG. 3 again, the front cover 21 and the housing 22 jointly include a receiving space 23 formed therein for fixedly accommodating the speaker 10. The speaker 10 is fixed to the front cover 21 and partitions the receiving space 23 to make a rear chamber 231. The housing 22 is provided with a through hole 28 formed at a bottom side thereof for an element (not shown) like a bass tube or an audio cable to pass through.

The housing 22 includes a drainage tunnel 26 formed at a rear side thereof, a first opening 24 formed at a top side thereof, a second opening 25 formed at a bottom side thereof, and a venthole 27 formed therein. The drainage tunnel 26 communicates with the first and second openings 24 and 25. In addition, the drainage tunnel 26 communicates with the rear chamber 231 via the venthole 27 to make a gas inside the rear chamber 231 exhaust through the first opening 24 and/or the second opening 25 via the venthole 27. The drainage tunnel 26 is formed of a curved portion 261 and a straight portion 262 communicating with the curved portion 261. The curved portion 261 and the straight portion 262 are recessed inward from an external rear surface of the housing 22. The curved portion 261 is L-shaped and includes one end communicating with the first opening 24 and a corner portion communicating with the venthole 27 to make the first opening 24 and the venthole 27 communicable with each other linearly. The straight portion 262 communicates with the second opening 25 as shown in FIG. 1. The housing 22 further includes a rear cover 40 at the rear side thereof for covering the external rear surface thereof. It is worth mentioning that the rear cover 40 can be integrally formed on the housing 22 instead, so it is not an essential element of the present invention; in addition, the second opening 25 can be formed on the rear cover 40 instead as the drainage tunnel 26 still functions normally.

The water-repellent breathable member 30 is formed of a plurality of pores, each of which is smaller than the venthole 27 in diameter, or formed of at least one metallic mesh made of stainless steel or at least one ventilative film made of polyurethane (PU) or polymeric material. The water-repellent breathable member 30 is formed in the venthole 27 for making the gas inside the rear chamber 231 be dissipated outward and meanwhile for preventing external moisture from entering the rear chamber 231, so the earphone 1 can have preferable acoustic performance within low-frequency range.

In operation, when the moisture does not enter the drainage tunnel 26 through the first opening 24, the gas inside the rear chamber 231 can flow out of the earphone 1 from the venthole 27 through the drainage tunnel 26 to properly decrease the pressure of the gas inside the rear chamber 231 and enhance the low-frequency acoustic performance when the speaker 10 makes sound. Since the first opening 24 and the venthole 27 communicate with each other linearly, the gas inside the rear chamber 231 can be easily dissipated.

When it is raining or a user is doing exercise, the rain or perspiration may enter the drainage tunnel 26 through the first opening 24. In the meantime, the water-repellent breathable member 30 can prevent the rain or perspiration from entering the rear chamber 231 and the rain or perspiration can be expelled out of the earphone 1 quickly through the drainage tunnel 26. Thus, the moisture can be prevented from entering the main body 20 of the earphone 1 and from damage to the speaker 10 and the frequency response of the earphone 1 within the low-frequency range can be restored to the gain as it is before the moisture enters the drainage tunnel 26, thus enhancing the acoustic performance of the earphone 1.

It is to be noted that the technical personnel in the art can make a third opening or more openings on the housing 22 to boost the drainage. In addition, the first and second openings 24 and 25 are not necessarily located at the top and bottom sides of the rear end of the housing 22 and can be located at other positions of the housing instead as long as the path between the venthole 27 and the first opening 24 or the second opening 25 makes the gas inside the rear chamber 231 communicable with the outside successfully.

What is claimed is:

1. A water-repellent earphone comprising:

a main body having a receiving space, a first opening, a second opening smaller than the first opening, a drainage tunnel, and a venthole, a speaker being mounted in the receiving space and partitioning the receiving space to make a rear chamber, the first and second openings being respectively formed on an external surface of the main body, the drainage tunnel communicating with the first and second openings, the venthole communicating with the drainage tunnel and the rear chamber; and a water-repellent breathable member formed on the venthole;

wherein the drainage tunnel comprises a curved pipe communicating with the first opening and the venthole, and a straight pipe communicating with the curved pipe and the second opening;

wherein the drainage tunnel draws off water from the first opening into the second opening.

2. The water-repellent earphone as defined in claim 1, wherein the first opening and the venthole communicate with each other linearly.

3. The water-repellent earphone as defined in claim 1, wherein the main body is formed of a front cover and a housing connected with the front cover.

4. The water-repellent earphone as defined in claim 3, wherein the speaker is mounted to the front cover.

5. The water-repellent earphone as defined in claim 3, wherein the drainage tunnel, the first opening, and the second opening are located at a rear side of the housing.

6. The water-repellent earphone as defined in claim 1, wherein the main body is formed of a front cover and a housing connected with the front cover; the curved pipe and the straight pipe are recessed inward from an external rear side of the housing, the housing having a rear cover mounted to a rear side thereof.

7. The water-repellent earphone as defined in claim 6, wherein the curved pipe comprises a corner portion communicating with the venthole.

8. The water-repellent earphone as defined in claim 7, wherein the curved pipe is L-shaped.

9. The water-repellent earphone as defined in claim 1, wherein the water-repellent breathable member is formed of a plurality of pores, each of which is smaller than the venthole in diameter.

10. The water-repellent earphone as defined in claim 1, wherein the water-repellent breathable member is formed of a metallic mesh made of stainless steel or a ventilative film made of polyurethane or polymeric material.

11. The water-repellent earphone as defined in claim 1, wherein the first opening and the second opening are deposited on different sides of the main body, so that water can be drained out of the main body.

* * * * *